US006092305A

United States Patent [19]

Troy et al.

[11] Patent Number: 6,092,305

[45] Date of Patent: Jul. 25, 2000

[54] FOOTWEAR STRUCTURE AND METHOD OF FORMING THE SAME

[75] Inventors: Gary J. Troy, Nottingham; Kenton D. Geer, Hampton, both of N.H.

[73] Assignee: Footwear Concept Center, Inc., Exeter, N.H.

[21] Appl. No.: 09/073,292

[22] Filed: May 6, 1998

[51] Int. Cl.[7] ..... A43B 7/08; A43B 13/14

[52] U.S. Cl. ..... 36/3 B; 36/25 R; 36/76 R; 36/29

[58] Field of Search ..... 36/3 B, 3 R, 43, 36/44, 28, 29, 76 R, 25 R, 76 HH

[56] References Cited

U.S. PATENT DOCUMENTS

| | | | |
|---|---|---|---|
| 597,524 | 1/1898 | Molloy et al. | 36/12 |
| 1,148,604 | 8/1915 | McBrearty . | |
| 2,317,918 | 4/1943 | Knipe . | |
| 2,371,322 | 3/1945 | Toothaker . | |
| 2,437,065 | 3/1948 | Austin | 36/3 B |
| 2,456,102 | 12/1948 | Agostinelli . | |
| 2,719,367 | 10/1955 | Bergmans | 36/12 |
| 2,887,793 | 5/1959 | Starr | 36/3 B |
| 4,627,178 | 12/1986 | Sullivan et al. | 36/43 |
| 4,739,765 | 4/1988 | Sidor et al. | 36/3 B X |
| 4,742,625 | 5/1988 | Sidor et al. | 36/3 R |
| 4,835,884 | 6/1989 | Bianchini et al. | 36/24.5 |
| 4,843,741 | 7/1989 | Yung-Mao | 36/28 X |
| 4,845,863 | 7/1989 | Yung-Mao | 36/28 X |
| 4,881,328 | 11/1989 | Yung-Mao | 36/28 |
| 5,086,572 | 2/1992 | Lee | 36/3 R |
| 5,400,526 | 3/1995 | Sessa | 36/3 B |
| 5,408,761 | 4/1995 | Gazzano | 36/88 |
| 5,469,693 | 11/1995 | Sessa | 36/28 |
| 5,675,914 | 10/1997 | Gintron | 36/3 B |
| 5,809,665 | 9/1998 | Suenaga | 36/43 |

*Primary Examiner*—Ted Kavanaugh
*Attorney, Agent, or Firm*—Hayes, Soloway, Hennessey, Grossman & Hage, P.C.

[57] ABSTRACT

A footwear structure including an outsole and a separate midsole having interlocking shank portions. The outsole has an upward extending arc in the shank area which defines a shank interlock portion on the top surface of the outsole. The midsole has a corresponding arc which defines a shank interlock portion on a bottom surface thereof which mates with the arc in the outsole for resisting motion of the midsole relative to the outsole in the case where the midsole is unsecured within the structure to allow for removal of the midsole. A rigid shank insert may be provided between the midsole and outsole. The midsole further includes a plurality of cushioning pads on a bottom surface of the midsole which are separated by air channels. The air channels extend along the length of the midsole and intersect with a heel cavity. A plurality of thru holes are formed in the midsole to extend from the top surface thereof to the air channels in the bottom surface.

30 Claims, 5 Drawing Sheets

FOOTWEAR STRUCTURE AND METHOD OF FORMING THE SAME

FIELD OF THE INVENTION

The present invention relates in general to footwear structures and, more particularly, is directed towards an improved footwear structure having an interlock between an outsole and a midsole.

BACKGROUND OF THE INVENTION

The ideal footwear design would incorporate the following essential features and characteristics: comfort, cushioning, shock absorption, stability, flexibility, support, good fit, and would also be lightweight. These features are achieved in, and are dependent upon, the structural and functional design elements of the footwear, which enhance the wearer's ability to perform various activities without pain or inconvenience.

To date, prior art footwear constructions have failed to successfully combine the essential features of an ideal design. Prior attempts to create the ideal footwear design have been unsuccessful largely because prior structures have emphasized one of the above-noted features to the detriment of others. Furthermore, prior attempts to construct an ideal footwear design have failed to consider the importance of other key features such as industrialized construction, style and fashion.

Prior art footwear constructions which provide cushioning generally have three or four separate parts. First, such conventional footwear designs are provided with an outsole. The outsole is made of a durable material that extends across the lower surface of the shoe and contacts the ground during use to provide traction. The outsole may also have integrally molded full or partial side walls extending upwardly around its periphery. Second, a midsole is permanently joined to the outsole on its interior upper surface and any abutting outsole interior side wall surfaces to provide a cushioning layer within the footwear structure. In some cases the midsole and outsole material are formed as one component of similar or dissimilar materials. Third, an upper, usually formed of leather, synthetics or other materials, is joined to the top surface of the midsole and any abutting interior sidewall surfaces of the outsole and midsole which extend upwardly around the periphery of the upper. Fourth, in many prior art constructions, a thin cushioning insole is further provided for disposal between the top surface of the midsole and the wearer's foot.

The conventional footwear cushioning components and their positioning within the footwear structures of prior art constructions have several undesirable characteristics. For example, it is well known in the art that the cushioning properties of the materials used in footwear midsole and insole designs are substantially reduced after the footwear has been used for a period of time. In some instances, a substantial reduction in cushioning can occur in a relatively short period of time. The footwear midsole and insole components are typically made of various foam and rubber materials which are subjected to repeated application of impact forces and stress which cause compression set, degradation, and fatigue resulting in reduced resiliency and failed cushioning properties. The typical foam midsole and insole cushioning materials are various formulations of sheet stock or molded eva, polyethylene, and polyurethane. The typical rubber materials are latex and neoprene.

The midsoles in prior art footwear constructions that are permanently attached to the footwear also have several undesirable characteristics. For example, the consumer at the point of purchase is unable to make an alternative choice in the cushioning characteristics of the midsole without selecting separate footwear designs. Also, the wearer is unable to replace the midsole component after it has degraded and lost its ability to provide adequate cushioning and support. In addition, the attachment of the midsole to other components in the footwear structure such as the top surface of the outsole, abutting outsole side wall interior surfaces, and to the formed upper negate the ability of the midsole component to adequately compress, deform, and rebound while providing maximum cushioning.

Another undesirable feature of prior art designs is that the ability of the footwear structure to provide maximum cushioning of the foot structures at the appropriate instant in the gait cycle is negated in prior footwear constructions by the positioning of semi-rigid and rigid structural elements in close proximity to the wearer's foot. The semi-rigid and rigid structural elements are typically positioned below the wearer's foot on the top surface of the midsole or slightly recessed into the top surface of the midsole. The typical semi-rigid and rigid structural elements are: shanks, shank stiffeners, lasting insoles, stabilizers, and fasteners. The shanks, shank stiffeners, lasting insoles, stabilizers, and fasteners are usually made of metals, fiber composites, thermoplastics, and fibrous paper board. All of these semi-rigid and rigid structural elements negate the performance and cushioning ability of the midsole, and therefore negatively impact user comfort.

In some footwear constructions a lasting margin structure is formed by the combination of gathered upper materials and the adhesives used to attach the upper to the lasting insole or top surface of the midsole. This lasting margin structure extends around and projects inward from the periphery of the lasting insole or midsole to a distance of approximately 15.0 mm to 25.0 mm creating a semi-rigid border within the footwear structure. This formed structure also negates the performance and cushioning ability of the midsole, to the detriment of user comfort.

Furthermore, midsoles in prior art footwear constructions that are permanently attached to the footwear have external surfaces, especially along the side portions thereof, which are exposed to environmental conditions such as heat, cold, water, ultraviolet rays, abrasion from rocks, sand, soil, punctures from sharp pointed objects, and cuts from sharp edged objects. The environmental conditions contribute to the failure of midsole component cushioning in two main ways: degradation of the midsole cushioning materials, and destruction of the means by which the midsole cushioning component is attached to the footwear structure.

Another undesirable feature of prior art designs is that the thin cushioning insole which is positioned between the top surface of the lasting insole or midsole and the wearer's foot is typically too thin to provide optimal cushioning.

In an attempt to overcome some of the above-described deficiencies of prior art designs, some prior art constructions have incorporated custom or removable midsole inserts. These structures, however, remain encumbered by undesirable characteristics. One such structure is described in U.S. Pat. No. 4,881,328 (hereinafter "the '328 patent") to Lin Yung-Mao. The '328 patent describes a structure with an outsole and a peripheral midsole. A midsole insert is disposed over the peripheral midsole with cushioning elements extending downward adjacent the outsole. Unfortunately, the midsole insert and cushion elements must conform to a matching lift height of the peripheral midsole member. The peripheral midsole member also provides the only method of retaining midsole insert and structural support for the peripheral area of the shoe. The upper must be attached to the top surface of the peripheral midsole member, and the bottom surface of the peripheral member is attached to the upper surface of the outsole. The midsole insert must have an outwardly projecting lip to cover the upper which is attached at the peripheral member. Thus, the method of construction is complex and inefficient, and does not provide for maximum full perimeter cushioning since the rigid peripheral member is in close proximity to the user's foot. The structure also has no means of providing for a midsole insert for a raised heel design typically found in dress, casual shoe, and boot constructions, and fails to provide air circulation within the structure.

Thus, a need exists in the art for an improved footwear structure that provides full perimeter maximum cushioning of the foot structures, support and stability for the foot structures, allows the positioning of semi-rigid and rigid structural elements away from the wearer's foot, and can provide maximum cushioning without the restrictions caused by attachment of the midsole to other components in the footwear structure. Further, a need exists for a removable custom midsole insert that: can be selected according to the wearer's cushioning preference, can be selected according to the wearer's weight, can be selected according to various performance feature options, can provide air circulation within the footwear's interior environment, can be replaced after a substantial reduction and degradation of midsole cushioning occurs and can protect the midsole cushioning element from damage due to environmental conditions.

OBJECTS OF THE INVENTION

Accordingly, it is a primary object of the present invention to provide a comfortable footwear structure which is lightweight, supportive, stable, and provides maximum full perimeter cushioning immediately below the wearers foot structure.

It is an another object of the present invention to provide a footwear structure having a removable midsole.

It is an another object of the present invention to provide a footwear structure having a removable midsole for a shoe with a raised heel area typically found in dress, casual, and boot designs.

It is an another object of the present invention to provide a footwear structure having a removable midsole with interlock between the outsole and midsole for resisting motion of the midsole relative to the outsole.

It is an another object of the present invention to provide a footwear structure having a removable midsole which allows shank support to be located between the outsole and midsole, away from the wearer's foot.

It is an another object of the present invention to provide a footwear structure having improved air circulation within the interior of the shoe.

It is an another object of the present invention to provide a footwear structure having a removable midsole that can be selected and replaced according to a consumer's preference for cushionability.

It is an another object of the present invention to provide a footwear structure having a removable midsole that can be cost-effectively mass produced.

It is another object of the present invention Lo improve the comfort of footwear structures delivered to consumers.

These and other objects of the present invention will become apparent from a review of the description provided below.

SUMMARY OF THE INVENTION

The footwear structure of the present invention is organized about the concept of providing an outsole having a shank interlock portion which mates with a corresponding shank interlock portion in a separate midsole. In a preferred embodiment, the outsole has an upward extending arc in the shank area which defines the shank interlock portion on the top surface of the outsole. The midsole has a corresponding arc which defines the shank interlock portion on a bottom surface thereof which mates with the arc in the outsole for resisting motion of the midsole relative to the outsole. Advantageously, the midsole may be permanently secured in the structure, or it may be left unsecured within the structure to allow for removal and replacement. In the case where the cushionability of the midsole degrades over time, the midsole may be removed and replaced to restore the overall comfort of the shoe. In addition, a semi-rigid or rigid shank insert, or a stabilizing material, may be provided between the midsole and the outsole, thereby removing rigid structural components from close proximity to a user's foot. Other advantageous features for providing air flow within the shoe, heel and forefoot cushioning, and manufacturability are also provided.

Specifically, a footwear structure according to present invention includes: an outsole having a Lop surface; and a midsole having a bottom surface removably disposed above the top surface of the outsole. In a preferred embodiment, an upper is secured to the outsole. The outsole preferably includes a peripheral wall extending from the periphery of the top surface with the upper being secured to the peripheral wall. The top surface of the outsole has an arched shank interlock portion which mates with a corresponding arched shank interlock portion in the bottom surface of the midsole. Advantageously, interlocking of the shank interlock portions of the outsole and the midsole resists motion of the midsole relative to the outsole.

In one embodiment, the upper has an interior surface and the midsole has a sidewall portion. The midsole is disposed above the outsole with the sidewall portion adjacent the interior surface of the upper. In a preferred embodiment, however, the upper has a bottom interior surface and a bottom exterior surface which includes an arched portion which mates with the upper surface of the outsole. The bottom exterior surface of the upper is secured to the top surface of the outsole, and the bottom surface of the midsole is removably disposed against the bottom interior surface of the upper.

The midsole has a top surface which is preferably contoured to generally conform to the bottom of a person's foot. In addition, a covering material may be secured to the top surface of the midsole to eliminate the need for a separate insole.

The midsole may be formed with portions defining a plurality of thru holes extending from the top surface of the midsole to the bottom surface of the midsole. The bottom surface of the midsole is formed with a plurality of cushion pads separated by a plurality of air channels and a heel cavity. Preferably, at least one of the air channels extends in the bottom surface of the midsole from the forefoot area to intersect the heel cavity.

A shank component or a layer of stabilizing material may be disposed between the midsole and the outsole to provide additional support and stability. The shank component has a top surface which corresponds and mates with the shank interlock portion in the bottom surface of the midsole and a bottom surface which corresponds and mates with the shank interlock in the outsole. Thus, due to the complimentary mating structure of the shank component/stabilizing layer, the interlock between the shank interlock portions of the midsole and outsole remains effective with the shank component disposed between the midsole and outsole.

A method of forming a footwear structure by combining the above-described outsole, upper, midsole, and, optionally, the shank component is also provided.

BRIEF DESCRIPTION OF THE DRAWING

For a better understanding of the present invention, together with other objects, features and advantages, reference should be made to the following description of the preferred embodiment which should be read in conjunction with the following figures wherein like numerals represent like parts.

DETAILED DESCRIPTION OF PREFERRED EMBODIMENT

Figure 1:
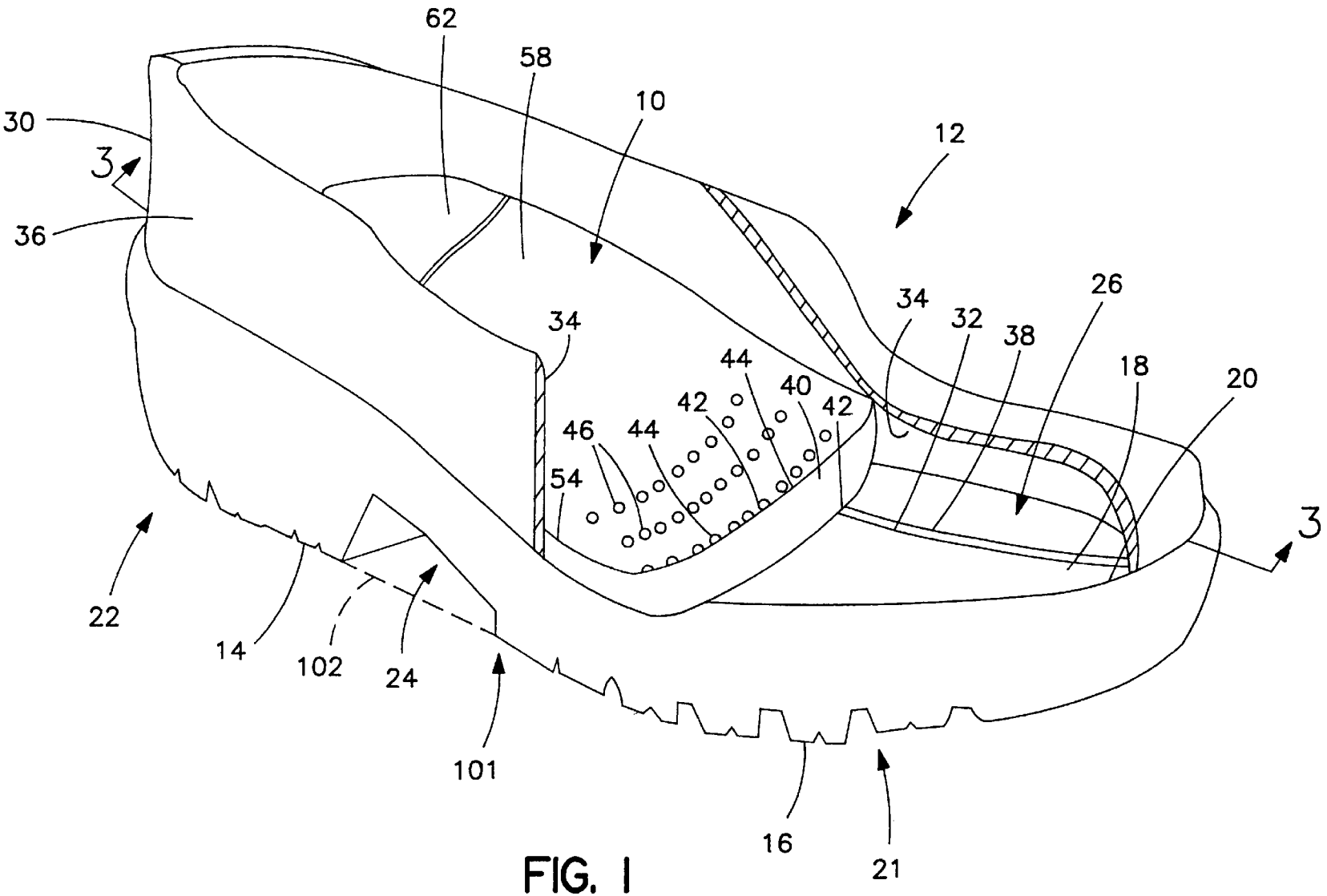
FIG. 1 is an isometric partial sectional view of a footwear structure according to the invention as fitted with a removable midsole therefor, with portions broken away to show interior structure.

Referring first to FIG. 1, an isometric view of a preferred embodiment of a shoe construction according to the invention is shown. A removable midsole insert is indicated generally at 10. Insert 10 is shown as combined with an outsole 14 and an upper 30 to form a footwear structure 12 according to the invention. While the upper 30 of the illustrated footwear structure 12 is shown in only outline form, it is to be understood that the invention can be employed in many types of athletic and non-athletic footwear structures such as walking shoes, running shoes, aerobic shoes, casual shoes, boots, ice skates, in-line skates, ski boots, etc. Those skilled in the art will recognize that any upper construction could be used with corresponding changes in the outsole design depending on the desired application. The invention also has application in any circumstance where a removable midsole with varying cushioning characteristics is desired or useful.

Outsole 14 generally forms the wearing surface of the shoe or footwear structure. Outsole 14 is preferably constructed of a relatively durable, resilient material such as rubber, and has an exterior surface that is provided with a suitable tread surface 16. Depending on the intended purpose of the structure, the outsole, however, it may be formed of a rigid or semi rigid material, as used, for example, in ski boots, ice skates or in-line skates. As used herein, therefore, the term "outsole" shall refer to the structural component which includes the bottom exterior surface 101 of the footwear structure. The outsole may be a unitary member which extends upward from the bottom surface to form the entire exterior surface of the structure, e.g. as in a rubber boot, molded in-line skate, ski boot, etc., or the outsole may have a separate upper 30 secured thereto for forming a portion of the exterior surface of the structure. Also, the bottom surface 101 may include a tread surface 16, or may have another element attached thereto, e.g. a skate blade, rollers etc.

Advantageously, a shank interlock portion 24 is formed in the outsole for forming a mating interlock with the removable midsole, as will be described in detail below. The top interior surface 18 of the outsole in the shank interlock portion arcs upwardly in the shank area prom the forefoot area 21 and arcs downwardly from the middle of the shank area to the heel area 22. The arc of the top surface 18 in the shank interlock portion is preferably continuous. It is possible, however, to form the arched shank interlock in a discontinuous fashion by providing discrete portions having top surfaces which form an arched plane on the top surface 18. It is also possible, although not preferable, to form the shank interlock portion in a non-uniform arched shape, and to provide an arch in the top surface which extends laterally across the shank interlock portion. From a manufacturing standpoint, however, it is preferable that the top interior surface 18 in the arched shank interlock portion of the outsole be in the form of a gradual and continuous arc from the forefoot area toward the heel, as shown.

On the bottom exterior surface 101 of the outsole, the interlock section preferably separates and defines the forefoot area 21 and the heel area 22. In the case where a flat bottomed structure with no defined heel is desired, the bottom surface 101 of the outsole in the shank interlock area 24 may be flat, i.e. following dashed line 102, or partially flat, e.g. with a "fiddle shank", instead of concave as shown. In an embodiment wherein all or part of the bottom surface is flat, the arched shank interlock 24 would remain in the top surface 18 of the outsole.

In the preferred embodiment, a peripheral wall or member 20 projects upwardly from the top surface 18. Peripheral member 20 is in the illustrated embodiment endless and extends completely around the periphery of outsole 14. While in the illustrated embodiment peripheral member 20 is endless, this need not necessarily be the case. Member 20 can for example take the form of several sections spaced around the periphery of the shoe, or the member could have varying and undulating heights as it wraps around the periphery of the shoe. It could also be formed as a separate component and secured, e.g. by adhesive, to the upper surface 18 of the outsole.

As discussed above, the peripheral wall could extend upwardly to form the entire exterior surface of the structure and the entire cavity in which a user's foot would be disposed. This would occur, for example, in a ski boot, a molded skate, etc. Preferably, however, the structure 12 further comprises an upper 30 which is secured to the outsole to form the exterior surface of the structure and foot cavity in combination with the outsole. While the illustrated upper is shown only in the outline form, those skilled in the art can readily choose an appropriate upper depending on intended use and/or aesthetics. The upper can be fashioned of leather, cloth, synthetic materials or a combination of these. In addition, although the illustrated upper 30 is shown as only a single layer of material, those skilled in the art will recognize that multiple materials could be combined in the upper to provide water proofing, warmth, support, physical protection for the foot, etc., as exist, for example, in GORE-TEX expanded polytetrafluoroethylene material or SYMPATEX membrane vapor-permeable waterproof boot-type constructions.

In the preferred embodiment, upper 30 has an exterior surface 36 with a bottom exterior surface 32 and an interior surface 34 with a bottom interior surface 38. The bottom exterior surface 32 is preferably attached to the outsole top surface 18 by a known adhesive or by molding the outsole directly to the upper by direct injection. Exterior upper surface 36 adjacent the sidewall surface 33 is also attached to interior sidewall surface 33 (FIG. 4) of peripheral member 20. It is possible, however, that the bottom of the upper could be removed or cut out. In this case, the upper would be secured to the outsole by attaching exterior surface 36 to the interior sidewall surface 33, or by attaching the interior surface 34 to the exterior sidewall surface 35. In the preferred embodiment, however, the interior surface 34, including interior bottom surface 38, form the central receptacle or cavity 26 that is dimensioned for receiving insert 10 and a user's foot of a particular size.

Insert 10 preferably comprises a midsole bottom surface 40 with a plurality of integrally formed channels 42 surrounding a plurality of integrally formed cushion pads 44. A plurality of thru holes 46 extend upward from the channels 42 to the midsole top surface 58 primarily in the forefoot area 50 of the midsole. As shown, insert 10 is formed so as to occupy substantially all of the receptacle 26.

In the preferred embodiment, when insert 10 is inserted into receptacle 26, the midsole bottom 40 is in contact with upper bottom interior surface 38 and the midsole sidewall 54 is positioned adjacent the interior upper surface 34. The shank area interlock portion 52 (FIG. 2) of the insert 10 contacts the interior upper surface 38 and mates with the corresponding shank interlock portion 24 of the outsole. In the case where the upper is formed without a bottom surface (not shown), the bottom surface of the midsole would directly contact the upper interior surface 18 of the outsole.

In any embodiment, however, the midsole is disposed above the outsole so that the bottom surface 40 in the shank interlock area 52 of the midsole mates with the arched top interior surface 18 in the shank interlock area 24 of the outsole. In the case where another structure, e.g. a shank insert, or bottom surface of an upper, is disposed between the midsole and the outsole, the midsole remains disposed above the outsole so that the shank interlock portions thereof mate, even though no direct contact may be made between the midsole and the outsole. Also, where the interior surface 18 in arched shank interlock portion of the outsole is formed in a discontinuous manner, bottom surface 40 in the arched shank interlock portion of the midsole may have a corresponding portion which mates with the discontinuity in the surface 18 in the outsole. This could provide additional interlocking between the outsole and midsole, but would increase the cost of manufacture for the structure.

Also, it is possible that the outsole could be formed with peripheral sidewalls 20 which extend above the height of the midsole which is disposed above the top surface of the outsole. This may be the case, for example, in a boot design. In this case, the midsole bottom surface could be directly disposed against the outsole upper surface or some intervening layer could be placed between the outsole and the midsole. Also, the midsole sidewall 54 would be disposed adjacent the outsole peripheral sidewall 20 with the upper being secured to the peripheral sidewall at a position above the top surface 58 of the midsole.

A covering material 62, which is preferably formed of a polyester/nylon material but can be formed of any suitable material, is preferably joined by gluing or molding to upper midsole surface 58 to provide a buffer between the midsole and a user's foot. Advantageously, therefore, the structure does not require any additional insole or sock liner placed on top of the midsole to be suitable for wearing. As shown, the upper midsole surface with covering material 62 preferably extends in both longitudinal and latitudinal directions to the midsole sidewall 54 without interruption.

Figure 2:
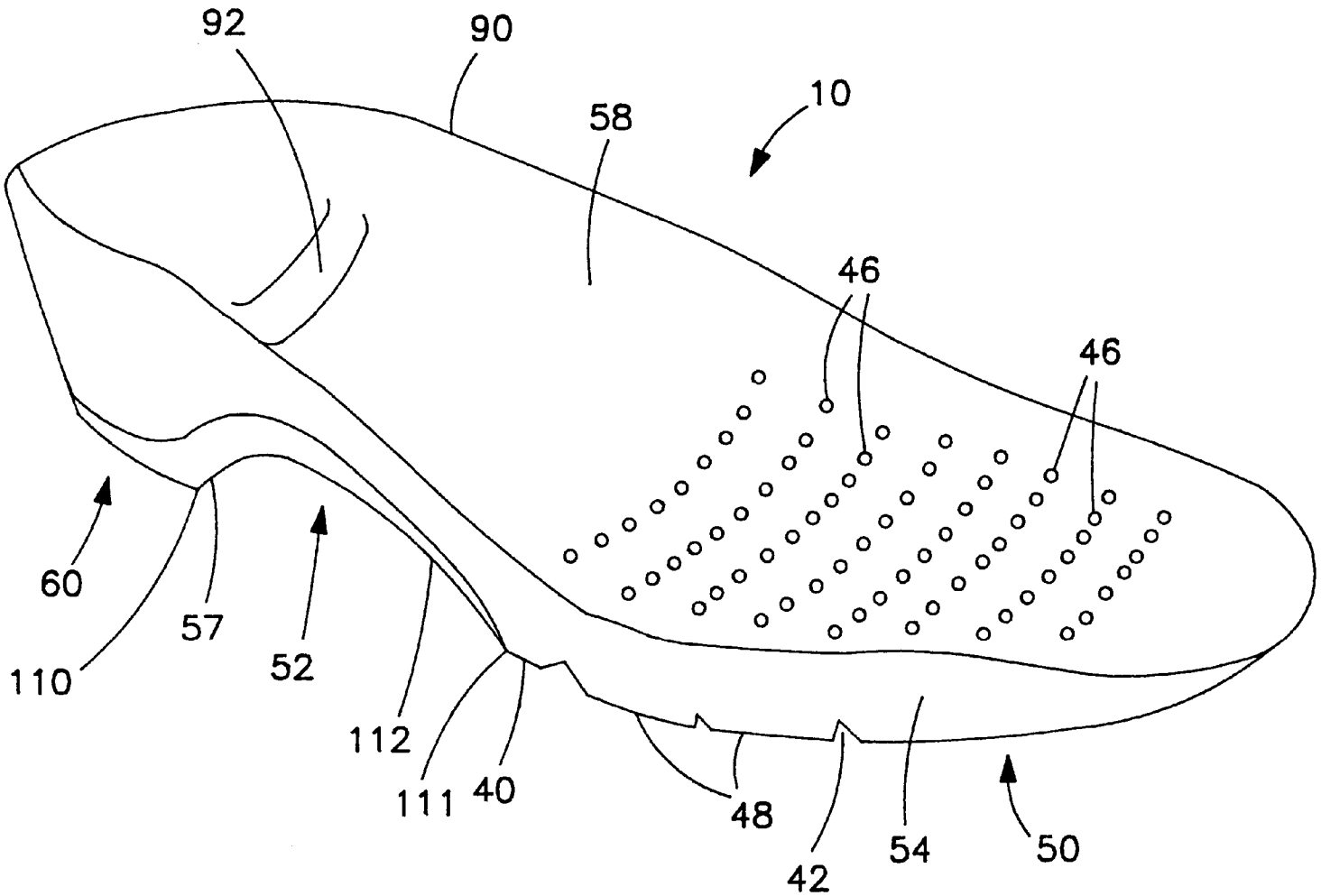
FIG. 2 is a top isometric view of a preferred embodiment of a removable midsole according to the invention.
Figure 3:
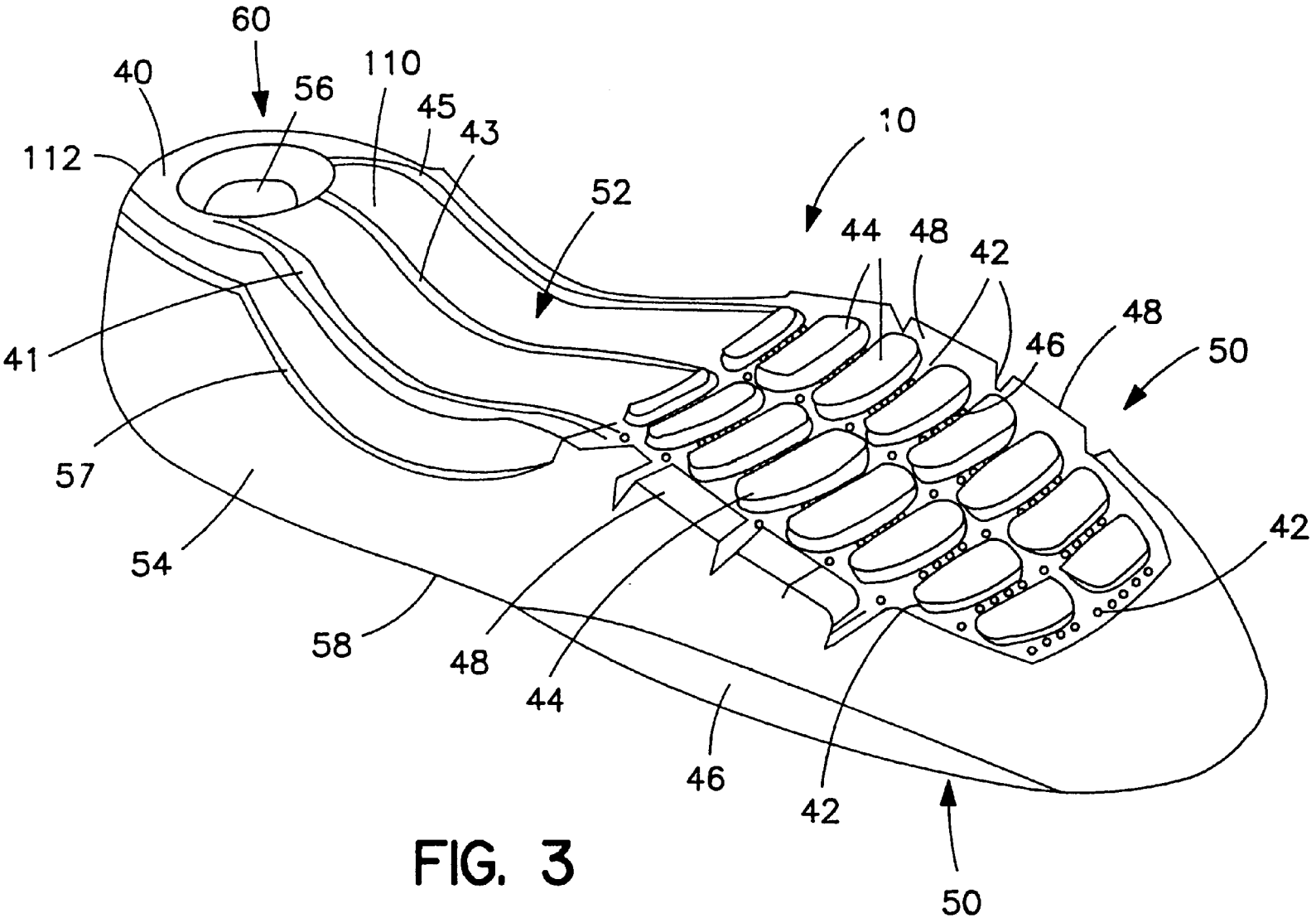
FIG. 3 is a bottom isometric view of the midsole shown in FIG. 2.

Referring now to FIGS. 2 & 3, insert 10 is preferably formed having a bottom surface 40 and a contoured top surface 58. The bottom surface 40 is preferably provided with a plurality of integrally formed channels 42 surrounding a plurality of integrally formed cushion pads 44. A plurality of thru holes 46 extend from the channels 42 to the midsole top surface 58 primarily in the forefoot area 50. Corresponding holes 63 may pass through the covering material 62.

In the illustrated embodiment, cushioning pads 44 take the form of geometric raised shapes surrounded by the channels 42. The combination of cushioning pads 44, channels 42, and thru holes 46 provides independent multi-point cushioning and ambient air flow circulation. This is because cushioning pads 44 will compress independently of each other, and at the same time force the ambient air that is located in the air channels 42 that surround the cushioning pads 44 to move within and around the channels 42 and up through the thru holes 46. The plurality of cushioning pads 44 are generally of the same depth.

A plurality of flex notches 48 are located on both the lateral and medial sides of insert 10 in the forefoot area 50 intersecting the midsole bottom 40 and the peripheral wall 54. Channels 42 separate the flex notches and extend in the peripheral wall 54. Channels 42 could also continue through the peripheral wall and extend into and through the top surface of the midsole. Thus, the channels 42 could pass fully or partially around the midsole to provide up to 360 degrees of air circulation.

Since the midsole bottom surface 40 is, in the preferred embodiment, in direct contact with the bottom interior surface 38 of the upper, the midsole bottom surface 40 is provided with a radiused edge 110 at the transition between the heel 60 and the shank interlock portion 52 and a radiused edge 111 at the transition between the forefoot area 50 and the shank interlock portion 52. A radiused edge 112 is also preferably formed at the transition between the bottom surface 40 and the peripheral wall 54. The radiused edges on the bottom surface 40 prolong the life of the structure by minimizing the possibility that the midsole will tear the upper during use.

As shown particularly in FIG. 2, the top or upper surface 58 of the midsole preferably has a smooth contour which generally matches the bottom contours of a human foot, thereby providing comfort and stability for a user. Thus, in the preferred embodiment, the top surface of the midsole has a slight concavity in the forefoot area 50. From the forefoot area to the heel area 60, the perimeter 90 of the midsole gradually increases relative to the center 92 in order to provide support and stability to a wearer's foot. The perimeter 90 may, however, extend above the center 92 of the midsole around all or part of periphery of the midsole. Advantageously, the midsole top surface can be designed to generally follow standard foot contours, or custom designed for a specific user. The midsole according to the present invention can, therefore, eliminate the need for a separate orthotic insert since contours which would be provided by an orthotic may be formed into the midsole.

In one embodiment, the midsole tapers in thickness from about 0.375" at the toe to about 0.75" at the ball to provide toe spring. The midsole is about 1.25" in thickness at the center of the heel area to provide heel lift. The perimeter 90 extends about 0.75" above the center 92 of the heel area, and the cushioning pads 44 and channels 42 are about 0.125" in depth relative to the bottom surface. The thru holes are about 0.0625" in diameter. Obviously, however, the dimensions set forth above are for but one preferred footwear structure, and may be changed based on desired comfort level, intended use, cost concerns, etc.

In the shank interlock area 52, portions 41, 43, 45, of the formed air channels 42 continue running in a longitudinal direction toward and intersect a domed cylindrical heel cavity 56 formed in the bottom surface 40 of the midsole. The heel cavity 56 allows the molded midsole to compress and move the ambient air within the cavity to flow thru the channels 42 and thru holes 46 when the foot structure bears weight upon the heel area 60. Thus, improved air flow through the midsole, is achieved. Further, the heel cavity provides additional cushioning ability because the geometry provides a collapsing/rebounding dome type structure.

Figure 4:
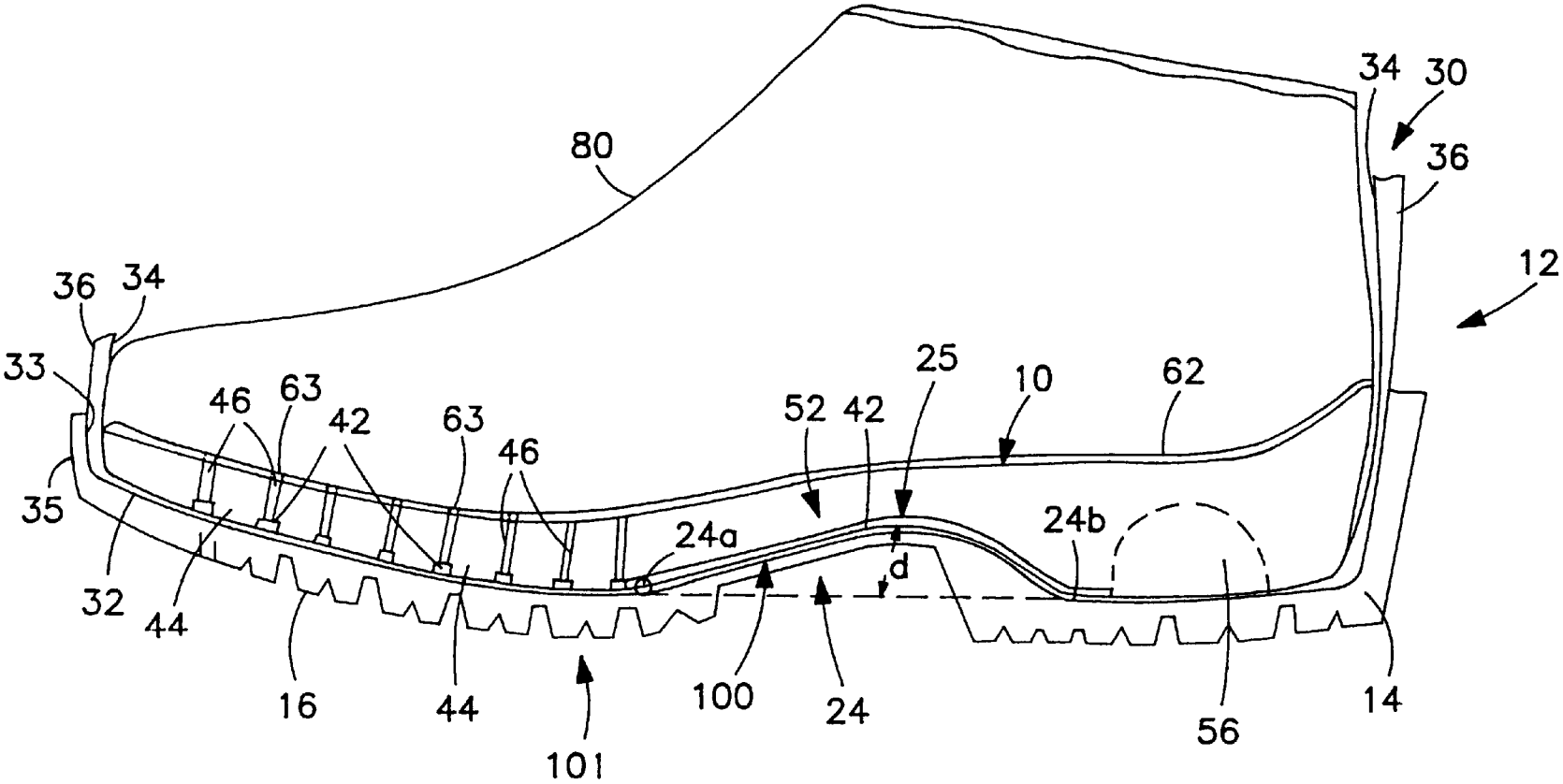
FIG. 4 is a longitudinal section taken substantially along line 3—3 of FIG. 1.

Referring now to FIG. 4, an elevational section taken substantially along line 3—3 of FIG. 1 is shown. FIG. 4 particularly illustrates the shank interlock portion 52 of midsole insert 10 and the mating interlock portion 24 of outsole 14. In the preferred embodiment, both the bottom surface 40 in the shank interlock portion 52 of the midsole and the top interior surface 18 in the mating shank interlock portion 24 of the outsole project upwardly with an arc-like geometry running longitudinally from the end of the forefoot portion at point 24*a* to the beginning of the heel portion at point 24*b*. Within this area, the upper surface 18 of the outsole and the bottom surface 40 of the midsole extend upward from the forefoot at about point 24*a* to approximately the middle of the shank area at point 25, and then downward to the heel to about point 24*b*. This structural design allows for a positive interlock between shank interlock areas of the midsole insert 10 and the outsole 14 which resists motion of the midsole relative to the outsole 14 when the structure is in use. Advantageously, therefore, the midsole need not be permanently secured within the structure, thereby allowing removal and replacement.

Furthermore, in the case where an upper is secured to the outsole in the structure, the unique arched geometry of the interlock areas allows use of an upper 30 having a corresponding arched shank area 100 in its bottom surface 32. Advantageously, the gradual arch of the upper bottom surface 32 allows for traditional methods of lasting, e.g. slip lasting or cement lasting, for construction of the upper. Preferably, however, slip lasting is used to stitch a bottom portion of the upper to a separate top portion.

Without the gradual arching of the shank interlock areas of the midsole and outsole, abrupt changes would be required in the bottom surface of the upper. Such abrupt changes would require use of either molded components or inefficient, non-traditional methods of lasting, which would unduly complicate the manufacturing process and increase the manufacturing cost. Thus, the shape of the interlock areas of the midsole and outsole should change in a gradual manner with radiused transitions at the forefoot and heel.

In a preferred embodiment, the distance d between the plane of points 24*a* and 24*b* to point 25 is about 0.625" where the total length of the outsole is about 11.5". It is to be understood, however, that the distance d can vary greatly with the shoe size and the intended application. Thus, any arching shank interlock portions formed in the top surface of the outsole and bottom surface of the midsole will suffice as long as a mating interlock between the midsole and the outsole is achieved which resists motion of the midsole relative to the outsole when the structure is in use.

Figure 5:
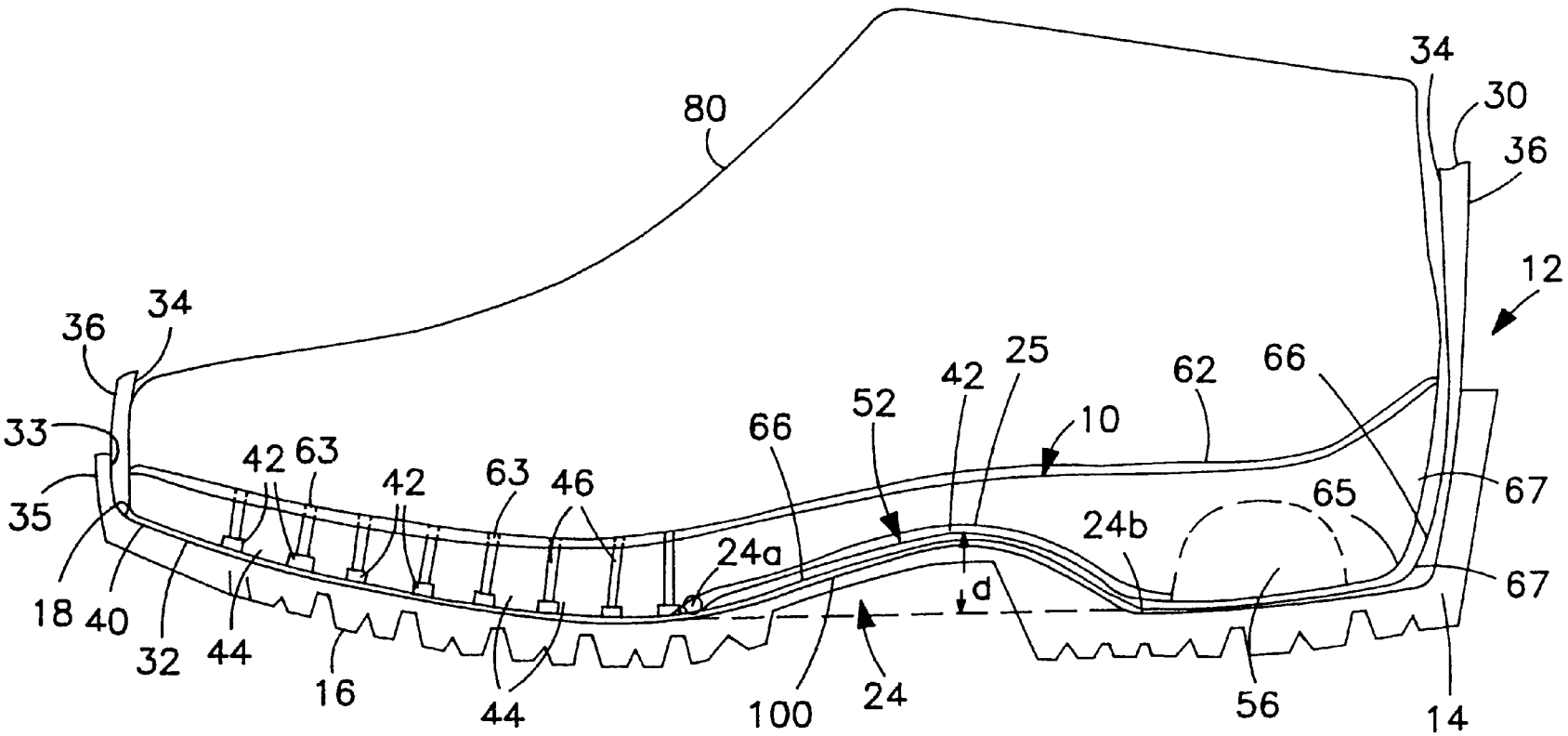
FIG. 5 is a longitudinal section taken substantially along line 3—3 of FIG. 1 and showing a rigid shank insert disposed between the midsole and the outsole according to the present invention.

In order to provide full and comfortable support of the wearer's foot 80, particularly in the midfoot or shank area, a shank component 66 may be included in the structure, as shown in FIG. 5. The shank component may be constructed of traditional rigid or semi-rigid materials, e.g. metal or plastic, and is formed with a top surface 65 which follows the contour of the bottom surface 40 of the midsole and a bottom surface 67 which follows the contour of the top surface 18 of the outsole. Referring back to FIG. 3, shank component 66 preferably has a thin projecting perimeter wall in the heel and shank areas to about the point 24*a* that mates with and rests against a recessed lip 57 in the sidewall 54 of the midsole. The shank component perimeter wall provides additional rigidity and support.

In one embodiment the shank component/reinforcing layer may be attached to the bottom of the midsole insert 10 by an adhesive or other means to extend from the rear 67 of the midsole to about the point 24*a*. Alternatively, the shank could extend longitudinally and laterally along the entire length and width of the structure, or any portion thereof. Also, the shank component could be secured to, or disposed against, the top surface of the outsole, to the bottom exterior surface of the upper, or a recess in either the outsole or midsole. The shank could also be formed as an integral part of either the outsole or midsole, rather than as a separate component. Importantly, however, the structure of the shank component allows the shank component to be disposed between the bottom surface of the midsole and the top surface of the outsole without effecting the interlock between the midsole and the outsole. The semi-rigid shank component is not, therefore, positioned in close proximity to the user's foot as in the prior art where such components would be positioned above a conventional midsole. By positioning the shank component beneath the midsole, the present invention provides footwear structure which provides significantly improved comfort compared to prior art structures which incorporate shank components.

There is thus provided a footwear structure including an outsole and a separate, removable midsole. In a preferred embodiment, the outsole has an upward extending arc in the shank area which defines a shank interlock portion on the top surface of the outsole. The midsole has a corresponding arc which defines a shank interlock portion on a bottom surface thereof which mates with the arc in the outsole for resisting motion of the midsole relative to the outsole. The midsole further includes a plurality of cushioning pads on a bottom surface of the midsole which are separated by air channels. The air channels extend along the length of the midsole and intersect with a heel cavity. A plurality of thru holes are formed in the midsole to extend from the top surface thereof to the air channels in the bottom surface.

Advantageously, the cushioning pads, thru-holes, channels and heel cavity, provide for improved cushioning and air circulation through the midsole. Also, due to the removability of the midsole, the midsole may be removed and replaced with one that fits a user's preference. Where the cushionability of the midsole degrades over time, the midsole may be replaced to restore the overall comfort of the shoe. Also, a rigid shank insert may be provided between the midsole and the outsole, thereby removing rigid components from close proximity to the user's foot.

The embodiments which have been described herein, however, are but some of the several which utilize this invention and are set forth here by way of illustration but not of limitation. For example, the structure described herein can be incorporated into a wide variety of footwear types and sizes. It is obvious that many other embodiments, which will be readily apparent to those skilled in the art, may be made without departing materially from the spirit and scope of this invention.

What is claimed is:

1. A footwear structure comprising:

an outsole having a top surface;

an upper extending from said outsole to at least partially define a cavity for receiving a foot; and a midsole disposed within said cavity and readily removable from said cavity, said midsole having a bottom surface disposed above said top surface of said outsole;

said top surface of said outsole having an arched shank interlock portion which mates with a corresponding arched shank interlock portion in said bottom surface of said midsole, whereby interlocking of said shank interlock portions of said outsole and said midsole resists motion of said midsole relative to said outsole.

2. A footwear structure according to claim 1, wherein said outsole has a peripheral wall extending from the periphery of said top surface, and wherein said upper extends from said peripheral wall.

3. A footwear structure according to claim 1, wherein said upper has a bottom surface with an arched portion which mates with said arched shank interlock portion of said top surface of said outsole.

4. A footwear structure according to claim 1, wherein said upper has an interior surface and said midsole has a sidewall portion, said midsole being removably disposed in said cavity above said outsole with said sidewall portion adjacent said interior surface of said upper.

5. A footwear structure according to claim 4, wherein said interior surface of said upper has a bottom portion and an exterior surface of said upper has a bottom portion, said bottom portion of said exterior surface being disposed against said top surface of said outsole, and said bottom surface of said midsole being removably disposed against said bottom portion of said interior surface of said upper.

6. A footwear structure according to claim 1, wherein said midsole has a top surface which is contoured to generally conform to the bottom of a person's foot.

7. A footwear structure according to claim 1, said structure further comprising a covering material secured to a top surface of said midsole.

8. A footwear structure according to claim 1, wherein said midsole further includes portions defining a heel cavity in said bottom surface.

9. A footwear structure according to claim 1, wherein said midsole has portions defining a plurality of thru holes extending from a top surface of said midsole to said bottom surface of said midsole.

10. A footwear structure according to claim 9, wherein said midsole has a plurality of pads extending from said bottom surface, said pads being separated by a plurality of air channels.

11. A footwear structure according to claim 10, wherein said midsole further includes portions defining a heel cavity in said bottom surface, and wherein at least one of said air channels extends in said bottom surface to intersect said heel cavity.

12. A footwear structure according to claim 1, wherein said structure further comprises a shank component, said shank component having a top surface which corresponds and mates with said shank interlock portion in said bottom surface of said midsole and a bottom surface which corresponds and mates with said shank interlock portion in said outsole, and wherein said shank component is disposed between said bottom surface of said midsole and said top surface of said outsole.

13. A footwear structure according to claim 12, wherein said shank is disposed against a bottom surface of said upper.

14. A footwear structure according to claim 1, wherein said upper is integrally formed with said outsole.

15. A footwear structure according to claim 1, wherein a bottom of said upper is disposed between said midsole and said outsole.

16. A footwear structure according to claim 1, wherein said cavity is defined by said upper and said outsole.

17. A footwear structure according to claim 1, wherein said arched shank interlock portion of said outsole comprises a continuous arc.

18. A method of forming a footwear structure comprising:

providing an outsole having a top surface with an arched shank interlock portion formed therein;

providing an upper;

securing said upper to said outsole, said upper at least partially defining a cavity for receiving a foot;

providing a midsole having a bottom surface with an arched shank interlock portion formed therein which mates with said arched shank interlock portion formed in said top surface of said outsole; and positioning said midsole in said cavity to be readily removable from said cavity with said midsole bottom surface above said outsole top surface for interlocking said shank interlock portions of said outsole and said midsole to resist motion of said midsole relative to said outsole.

19. A method according to claim 18, wherein said upper has a bottom surface with an arched portion which mates with said arched shank interlock portion in said top surface of said outsole.

20. A method according to claim 18, wherein said upper has an interior surface and said midsole has a sidewall portion, said midsole being removably disposed above said outsole with said sidewall portion adjacent said interior surface of said upper.

21. A method according to claim 20, wherein said interior surface of said upper has a bottom portion and an exterior surface of said upper has a bottom portion, said bottom portion of said exterior surface being disposed against said top surface of said outsole, and said bottom surface of said midsole being removably disposed against said bottom portion of said interior surface of said upper.

22. A method according to claim 18, wherein said midsole has a top surface which is contoured to generally conform Lo the bottom of a person's foot.

23. A method according to claim 18, wherein a covering material is secured to a top surface of said midsole.

24. A method according to claim 18, wherein said midsole further includes portions defining a heel cavity in said bottom surface.

25. A method according to claim 18, wherein said midsole has portions defining a plurality of thru holes extending from a top surface of said midsole to said bottom surface of said midsole.

26. A method according to claim 25, wherein said midsole has a plurality of pads extending from said bottom surface, said pads being separated by a plurality of air channels.

27. A method according to claim 26, wherein said midsole further includes portions defining a heel cavity in said bottom surface, and at least one of said air channels extends in said bottom surface from said forefoot area to intersect said heel cavity.

28. A method to claim 18, wherein said method further comprises:

providing shank component, said shank component having a top surface which corresponds and mates with said shank interlock portion in said bottom surface of said midsole and a bottom surface which corresponds and mates with said shank interlock portion in said outsole; and positioning said shank component between said bottom surface of said midsole and said top surface of said outsole.

29. A method according to claim 18, wherein said upper is integrally formed with said outsole.

30. A footwear structure comprising:

an outsole having a top surface;

an upper extending from said outsole to at least partially define a cavity for receiving a foot; and a midsole disposed within said cavity and readily removable from said cavity, said midsole having bottom surface disposed above said top surface of said outsole;

wherein said top surface of said outsole has an arched shank interlock portion which mates with a corresponding arched shank interlock portion in said bottom surface of said midsole, whereby interlocking of said shank interlock portions of said outsole and said midsole resists motion of said midsole relative to said outsole, wherein said midsole has portions defining a plurality of thru holes extending from a top surface of said midsole to said bottom surface of said midsole, and wherein said midsole has a plurality of pads extending from said bottom surface, said pads being separated by a plurality of air channels.

* * * * *

UNITED STATES PATENT AND TRADEMARK OFFICE

CERTIFICATE OF CORRECTION

PATENT NO. : 6,092,305
DATED : July 25, 2000
INVENTOR(S) : Gary J. Troy and Kenton D. Geer It is certified that error appears in the above-identified patent and that said Letters Patent is hereby corrected as shown below:

Column 12, claim 22,
Line 50, change "Lo" to -- to --.

Column 14, claim 30,
Line 2, insert "a" after "having".

Signed and Sealed this

Twenty-sixth Day of February, 2002

*Attest:*

*Attesting Officer*

JAMES E. ROGAN
*Director of the United States Patent and Trademark Office*